US008365946B2

(12) United States Patent
Abercrombie et al.

(10) Patent No.: US 8,365,946 B2
(45) Date of Patent: Feb. 5, 2013

(54) DEVICE WITH EXPANDABLE CHAMBER FOR PRESSURIZING CONTAINERS

(75) Inventors: James Scott Abercrombie, Greenwich, CT (US); Nicholas Joseph Day, Henderson, NV (US); Darren L. Naud, Los Alamos, NM (US)

(73) Assignee: Inoflate, LLC, Greenwich, CT (US)

( * ) Notice: Subject to any disclaimer, the term of this patent is extended or adjusted under 35 U.S.C. 154(b) by 0 days.

(21) Appl. No.: 12/622,080

(22) Filed: Nov. 19, 2009

(65) Prior Publication Data

US 2010/0127008 A1 May 27, 2010

Related U.S. Application Data

(60) Provisional application No. 61/199,798, filed on Nov. 20, 2008.

(51) Int. Cl.
*B65D 1/32* (2006.01)

(52) U.S. Cl. ... 220/721; 206/217; 215/228; 215/DIG. 8; 220/212; 220/521; 53/432

(58) Field of Classification Search ..... 206/217, 206/219; 215/228, DIG. 8; 220/212, 521, 220/720–722; 53/431, 432, 440
See application file for complete search history.

(56) References Cited

U.S. PATENT DOCUMENTS

| | | | | | |
|---|---|---|---|---|---|
| 3,857,423 | A | * | 12/1974 | Ronca, Jr. | 141/5 |
| 3,868,218 | A | * | 2/1975 | Tornmarck et al. | 436/183 |
| 3,888,998 | A | * | 6/1975 | Sampson et al. | 426/67 |
| 4,007,134 | A | * | 2/1977 | Liepa et al. | 426/561 |
| 4,025,655 | A | * | 5/1977 | Whyte et al. | 426/66 |
| 4,103,772 | A | * | 8/1978 | Wiegner | 206/222 |
| 4,110,255 | A | * | 8/1978 | Liepa et al. | 426/561 |
| 4,186,215 | A | * | 1/1980 | Buchel | 426/86 |
| 4,214,011 | A | * | 7/1980 | Strube | 426/591 |
| 4,316,409 | A | * | 2/1982 | Adams et al. | 99/275 |
| 4,458,584 | A | * | 7/1984 | Annese et al. | 99/323.1 |
| 4,466,342 | A | | 8/1984 | Basile et al. | |
| 4,475,448 | A | * | 10/1984 | Shoaf et al. | 99/323.1 |
| 4,662,154 | A | * | 5/1987 | Hayward | 53/431 |
| 5,033,254 | A | * | 7/1991 | Zenger | 53/431 |
| 5,251,424 | A | * | 10/1993 | Zenger et al. | 53/431 |
| 5,255,812 | A | * | 10/1993 | Hsu | 220/277 |

(Continued)

FOREIGN PATENT DOCUMENTS

| | | | | |
|---|---|---|---|---|
| EP | 258057 | A2 | * | 3/1988 |
| GB | 2076628 | A | * | 12/1981 |

(Continued)

OTHER PUBLICATIONS

International Search Report for corresponding to International Patent Application No. PCT/US2009/065245 dated Jan. 26, 2010.

*Primary Examiner* — J. Gregory Pickett
*Assistant Examiner* — Ned A Walker
(74) *Attorney, Agent, or Firm* — Ohlandt, Greeley, Ruggiero & Perle, LLP

(57) ABSTRACT

A container, such as a bottle or jar, that includes a closed compartment and an active insert device for pressurizing the closed compartment. The active insert device comprises an elastic liner and an active insert that are affixed to a closure or cap or the container. The active insert includes at least one reactant that is triggered to a reaction by an external energy source. The reaction produces a gas, which is delivered to the closed compartment via the liner. The gas causes the liner to expand and open a passage to deliver the gas to the closed compartment.

15 Claims, 9 Drawing Sheets

U.S. PATENT DOCUMENTS

| | | | | |
|---|---|---|---|---|
| 5,270,069 | A * | 12/1993 | Plester | 426/398 |
| 5,456,929 | A * | 10/1995 | Mifune et al. | 426/118 |
| 5,705,211 | A | 1/1998 | Bedell et al. | |
| 5,827,555 | A * | 10/1998 | Thorne et al. | 426/112 |
| 6,244,022 | B1 * | 6/2001 | Cornell et al. | 53/432 |
| RE38,067 | E * | 4/2003 | Gueret | 206/222 |
| 7,159,374 | B2 | 1/2007 | Abercrombie et al. | |
| 7,625,114 | B2 * | 12/2009 | Suchan et al. | 366/130 |
| 7,637,082 | B2 * | 12/2009 | Abercrombie et al. | 53/432 |
| 7,887,231 | B2 * | 2/2011 | Suchan et al. | 366/130 |
| 2003/0017236 | A1 | 1/2003 | Makita et al. | |
| 2004/0200738 | A1 * | 10/2004 | Rovelli et al. | 206/217 |
| 2005/0155325 | A1 * | 7/2005 | Abercrombie et al. | 53/401 |
| 2007/0045312 | A1 * | 3/2007 | Abercrombie et al. | 220/212 |
| 2007/0090000 | A1 | 4/2007 | Hjalmarsson | |
| 2007/0253761 | A1 * | 11/2007 | May | 401/133 |
| 2009/0120038 | A1 * | 5/2009 | Abercrombie et al. | 53/440 |
| 2009/0152267 | A1 * | 6/2009 | May et al. | 220/23.83 |
| 2009/0255929 | A1 * | 10/2009 | Abercrombie et al. | 220/212 |

FOREIGN PATENT DOCUMENTS

| | | | |
|---|---|---|---|
| WO | WO 9944901 | A1 * | 9/1999 |

* cited by examiner

DEVICE WITH EXPANDABLE CHAMBER FOR PRESSURIZING CONTAINERS

RELATED APPLICATION

This application claims the benefit of U.S. Provisional Application, Ser. No. 61/199,798, filed on Nov. 20, 2008, the entire contents of which are incorporated herein.

FIELD OF THE INVENTION

This invention relates to a method and device for pressurizing containers. The devices of the invention include a container and a cap. The container may be partially filled with liquid or solid products.

BACKGROUND OF THE INVENTION

Devices for pressurizing containers are disclosed in U.S. Pat. No. 7,159,374, the entire contents of which are incorporated herein by reference. As described in this patent, to prevent microbial spoilage, a hot fill process is often used to package many food and beverage products at high temperatures to sterilize both the product and container. When the liquid content of the container cools, it contracts and either creates an internal vacuum or causes the container to deform, as by shrinking, buckling or paneling. Currently, plastic bottles are designed with panels, ribs and additional resin to compensate for the contraction and prevent bottle deformation. When the smooth side wall of the bottle is replaced with these panels, flexible packaging shapes and designs are prevented, thereby making label application difficult.

An approach to the bottle deformation problem adds a gas, such as carbon dioxide or liquid nitrogen to the bottle after the liquid is hot-filled and before sealing. This approach is described in U.S. Pat. Nos. 4,662,154, 5,033,254 and 5,251,424 and in German Offenlegungsschrift No. DE 40 36 421 A1. For example, the process described in U.S. Pat. No. 5,251,424 introduces liquid nitrogen into the bottle before sealing to prevent thermal distortion of the bottle upon cooling of the hot liquid.

After closing, the gas expands within the headspace and the pressure inside the container rises rapidly providing rigidity to the container. This operation is most effective when applied to cold filled plastic containers that can accept relatively high pressures without stretching and deforming. At hot fill temperatures, however, the container looses its design strength. This loss of strength allows the container to stretch and deform, making it impossible to pressurize the container to the same pressure levels that can be achieved with cold fill operations.

Another approach to the bottle deformation problem adds a carbon dioxide releasing device to the container before sealing. This approach is described in U.S. Pat. Nos. 5,270,069 and 6,244,022. For example, the device described in U.S. Pat. No. 5,270,069 comprises a pencil shaped device that includes two compartments in which are disposed different reagents that, when brought into contact, react to release carbon dioxide into the headspace of the bottle. The user must remove the device before consuming the beverage.

Packaged beverages that contain a carbonation device that is activated at the point of consumption to carbonate the beverage are described in U.S. Pat. Nos. 3,888,998, 4,007,134, 4,110,255, 4,186,215, 4,316,409, 4,458,584, 4,475,448, 4,466,342 and in British Patent Application GB 2 076 628 A. Sieve tablets used in many of these devices are described in U.S. Pat. Nos. 3,888,998, 4,007,134, and 4,110,255, as well as in U.S. Pat. Nos. 4,025,655 and 4,214,011. These sieve tablets leave a residue that must be removed from the beverage prior to consumption.

In a hot fill process, the food and beverage products are pasteurized and then filled into containers at high temperature. The entire heating and cooling cycle can take a significant amount of time meaning that the actual food or beverage components are exposed to high temperatures for extended periods of time. During this time, certain components referred to as "Heat Sensitive Components" can become degraded by the high temperatures and lose their true aromatic and flavor characteristics.

Thus, there is a need for a method that releases gas in a closed container to retain microbial stability without leaving a residue or a device that must be removed at time of consumption.

There is also a need to eliminate buckling or paneling in closed hot filled containers in order to capture decorative, lightweight and flexibility benefits.

There is also a need to sufficiently pressurize a closed hot filled container in order to capture structural benefits without deforming the container.

There is a further need to release ingredients and functional components to closed containers on a time delayed basis to enhance functionality.

There is still another need for a container in which gas can be released to pressurize the container after the container is sealed.

There is yet another need for a closure or cap for a container that can release gas into the container after sealing to pressurize the container.

SUMMARY OF THE INVENTION

The present disclosure relates to a container that comprises an active insert device disposed in a closed compartment. The active insert device comprises an expansion chamber and an active insert disposed in the expansion chamber. The active insert comprises at least one reactant that is triggerable to a reaction by an external energy source to produce gas in the expansion chamber to increase a pressure of the expansion chamber and to expand at least a portion thereof to open a passage through which the gas is released to the closed compartment.

In another aspect of the container of the present disclosure, the active insert is spaced from the portion.

In another aspect of the container of the present disclosure, the reaction is a type selected from the group consisting of: chemical decomposition, combustion, substitution, acid-base, Redox or organic reaction.

In another aspect of the container of the present disclosure, the external energy source produces the triggering of the reaction with energy selected from the group consisting of: thermal induction; photo initiation; thermally through external heating, friction generated through either mechanical or ultrasonic energy, infrared light spectrum or electric heating coil; shock, impact or vibration through the application of mechanical force, ultrasonic energy, microwave radiation; electrically through an electrostatic discharge; and directed radiation of energetic particles and electromagnetic energy.

In another aspect of the container of the present disclosure, the reactant is a blend of any one or more selected from the group consisting of: gas generating propellants, oxidizers, stabilizers, binders, organic compounds and inorganic compounds.

In another aspect of the container of the present disclosure, the organic and inorganic compounds are selected from the group consisting of: azo and nitro compounds, amines, tetrazoles, ammonium and metal salts.

In another aspect of the container of the present disclosure, the portion of the expansion chamber comprises elasticity and elastically expands from an unstretched condition as the pressure increases and elastically returns to the unstretched condition when the pressure equilibrates with a pressure of the closed container.

In another aspect of the container of the present disclosure, the passage comprises an aperture through which the gas is released into the container.

In another aspect of the container of the present disclosure, the portion ruptures as the pressure increases to produce the aperture, which closes as the portion returns toward the unstretched condition.

In another aspect of the container of the present disclosure, the portion has a shape selected from the group consisting of: a flat liner and a liner that comprises a recess.

In another aspect of the container of the present disclosure, the active insert is disposed in the recess.

In another aspect of the container of the present disclosure, the external energy source provides electromagnetic energy, wherein the active insert device comprises an inductor that responds to the electromagnetic energy to trigger the reaction.

In another aspect of the container of the present disclosure, the external energy source provides light energy, wherein the active insert device responds to the light energy to trigger the reaction.

In another aspect of the container of the present disclosure, the container further comprises a cap that includes a transparent section, and wherein the light energy is incident to the transparent section.

In another aspect of the container of the present disclosure, the compartment further comprises a neck, wherein the cap is disposed on the neck, and wherein the active insert device is disposed in the cap.

In another aspect of the container of the present disclosure, the active insert device is disposed in a recess of the cap.

In another aspect of the container of the present disclosure, the container further comprises a liner that includes the portion of the expansion chamber and that is disposed in the cap to form an hermetic seal with the neck of the compartment.

The present disclosure also relates to a method of pressurizing a container that comprises:

disposing an expansion chamber in the container, wherein the expansion chamber has at least a portion that comprises elasticity; and initiating a reaction in the expansion chamber to expand the portion of the expansion chamber from an unstretched condition to open a passage through which the gas is released to the container.

In another aspect of the method of the present disclosure, the portion elastically returns to the unstretched condition as the pressure equilibrates with a pressure of the container, and wherein the aperture closes as the portion elastically returns toward the unstretched condition.

In another aspect of the method of the present disclosure, the method further comprises providing energy from an external source to initiate the reaction.

In another aspect of the method of the present disclosure, the energy is selected from the group consisting of: thermal induction; photo initiation; thermally through external heating, friction generated through either mechanical or ultrasonic energy, infrared light spectrum or electric heating coil; shock, impact or vibration through the application of mechanical force, ultrasonic energy, microwave radiation; electrically through an electrostatic discharge; and directed radiation of energetic particles and electromagnetic energy.

In another aspect of the method of the present disclosure, the reaction is a type selected from the group consisting of: chemical decomposition, combustion, substitution, acid-base, Redox or organic reaction.

In another aspect of the method of the present disclosure, the reactant is a blend of any one or more selected from the group consisting of: gas generating propellants, oxidizers, stabilizers, binders, organic compounds and inorganic compounds.

In another aspect of the method of the present disclosure, the organic and inorganic compounds are selected from the group consisting of: azo and nitro compounds, amines, tetrazoles, ammonium and metal salts.

In another aspect of the method of the present disclosure, the passage comprises an aperture through which the gas is released into the container.

In another aspect of the method of the present disclosure, the portion has a shape selected from the group consisting of: a flat liner and a liner that comprises a recess.

In another aspect of the method of the present disclosure, the active insert is disposed in the recess.

The present disclosure also relates to a cap that comprises a rim that is styled for fitting on a container neck and a surface connected to the rim. A liner disposed within the rim to form an expansion chamber between the liner and the surface. An active insert device disposed in the expansion chamber.

In another aspect of the cap of the present disclosure, the liner is selected from the group consisting of: flat liner and recessed liner.

In another aspect of the cap of the present disclosure, at least a portion of the liner comprises elasticity.

In another aspect of the cap of the present disclosure, the active insert device comprises a reactant that when triggered to a reaction, releases a gas that increases a pressure of the expansion chamber and causes the portion to elastically expand from an unstretched condition to rupture and produce an aperture through which the gas is released and elastically returns to the unstretched condition when the pressure equilibrates with a pressure outside the expansion chamber, and wherein the aperture closes as the portion elastically returns toward the unstretched condition.

In another aspect of the cap of the present disclosure, the expansion chamber comprises a recess in a location selected from the group consisting of: the liner and the surface of the cap.

In another aspect of the cap of the present disclosure, the active insert device is disposed in the recess.

In another aspect of the cap of the present disclosure, the surface comprises a section that is transparent to light energy. The active insert device comprises a reactant and responds to the light energy to trigger the reactant to a reaction in the expansion chamber.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
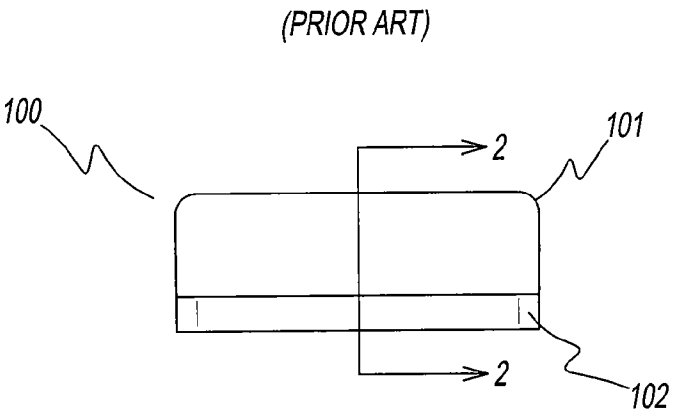
FIG. 1 is a side view of a prior art standard cap for a container.
Figure 2:
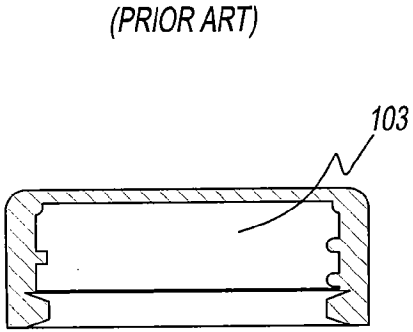
FIG. 2 is a cross-sectional view along line 2 of FIG. 1.

Referring to FIGS. 1 and 2, a standard bottle closure 100 comprises a cap 101 and pilfer band 102. Cap 101 has a recess 103 adapted to accept a recessed liner (not shown in FIGS. 1 and 2).

Figure 3:
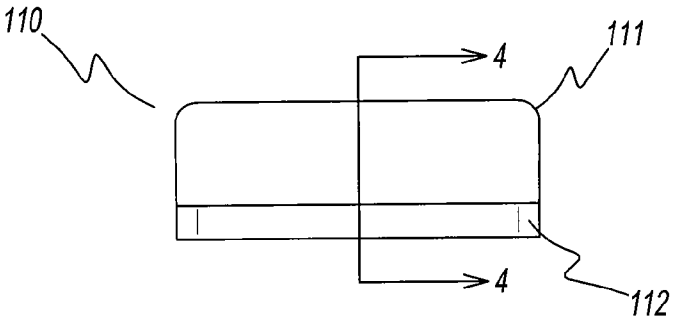
FIG. 3 is a side view of a recessed cap for a container.
Figure 4:
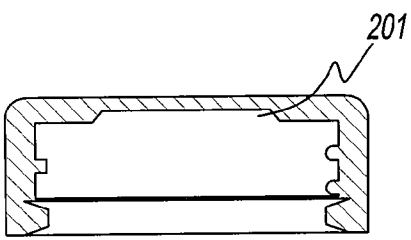
FIG. 4 is a cross-sectional view along line 4 of FIG. 3.

Referring to FIGS. 3 and 4, a recessed bottle closure 110 comprises a cap 111 and a pilfer band 112. Cap 111 has a recess 201 adapted to accept a multi-layer active insert device (not shown in FIGS. 3 and 4).

Figure 6:
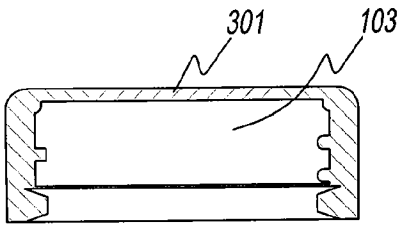
FIG. 6 is a cross-sectional view along line 6 of FIG. 5.
Figure 5:
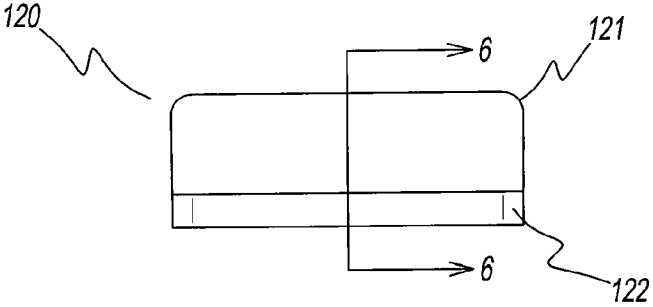
FIG. 5 is a side view of a cap with a transparent window for a container.
Figure 7:
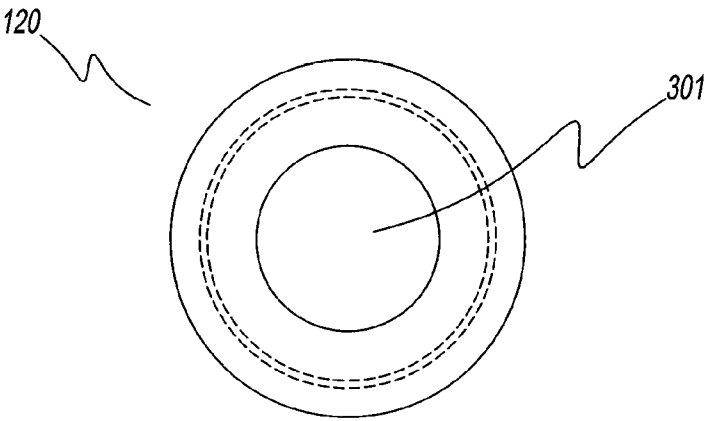
FIG. 7 is a top view the cap of FIG. 5.

Referring to FIGS. 5-7, a bottle closure 120 comprises a cap 121 and a pilfer band 122. Cap 121 has a liner recess 103 adapted to accept a recessed liner (not shown in FIGS. 5-7) and a transparent window 301 designed to allow light energy to pass through.

Figure 9:
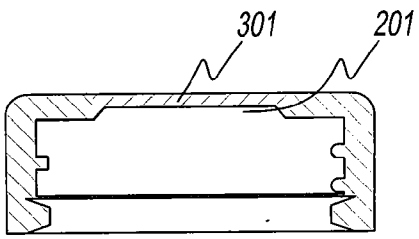
FIG. 9 is a side view along line 9 of FIG. 8.
Figure 8:
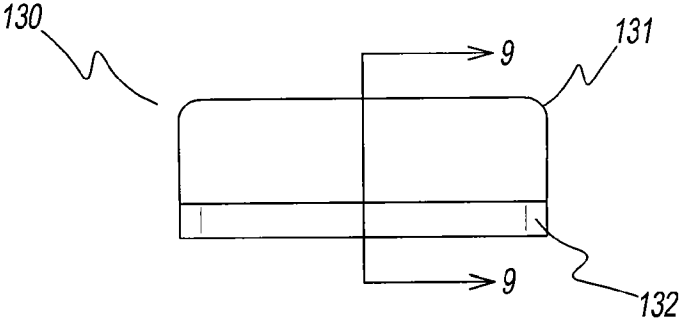
FIG. 8 is a side view of a recessed cap with a transparent window.
Figure 10:
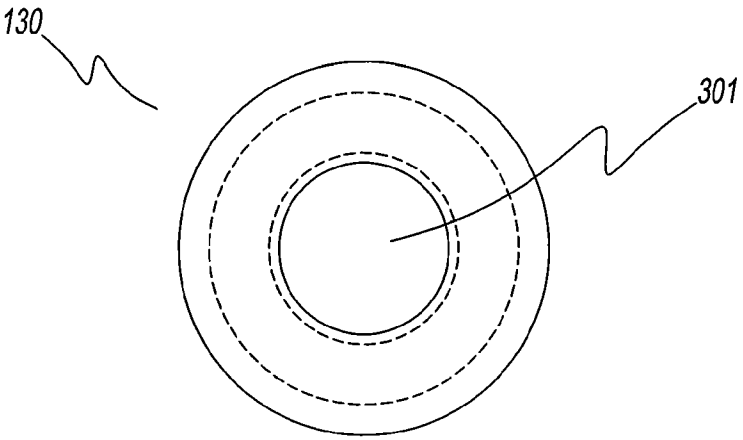
FIG. 10 is a top view of the recessed cap with a transparent window of FIG. 8.

Referring to FIGS. 8-10, a recessed bottle closure 130 comprises a cap 131 and pilfer band 132. Cap 131 has a recess 201 adapted to accept a bi-layer active insert device (not shown in FIGS. 8-10) and a transparent window 301 designed to allow light energy to pass through.

Figure 12:
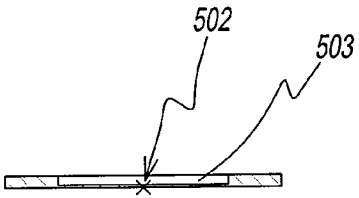
FIG. 12 is a cross-sectional view along line 12 of FIG. 11.
Figure 11:
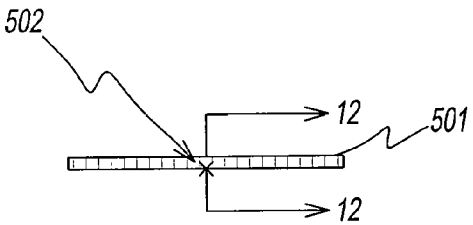
FIG. 11 is side view of a recessed liner for a standard cap.
Figure 13:
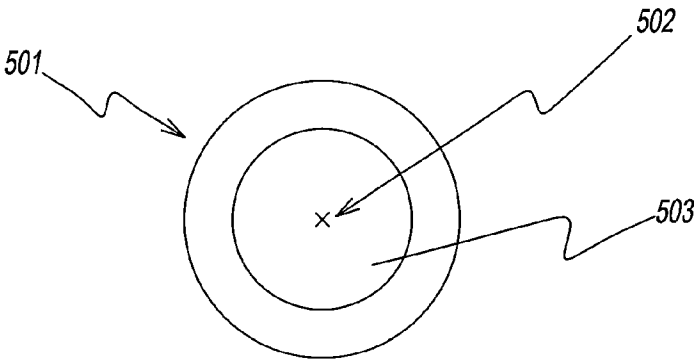
FIG. 13 is a top view of the recessed liner of FIG. 11.

Referring to FIGS. 11-13, a recessed liner 501 comprises a recess 503 designed to accept a multi-layer active insert device (not shown in FIGS. 11-13) and a score mark 502 designed to rupture in a controlled fashion.

Figure 15:
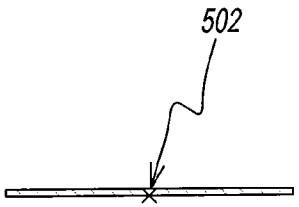
FIG. 15 is a cross-sectional view along line 15 of FIG. 14.
Figure 14:
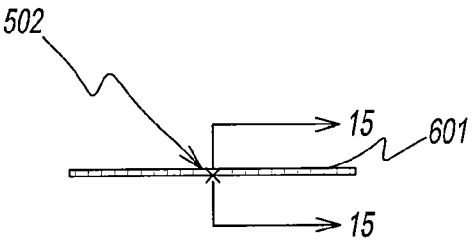
FIG. 14 is a side view of a flat liner for a recessed cap.
Figure 16:
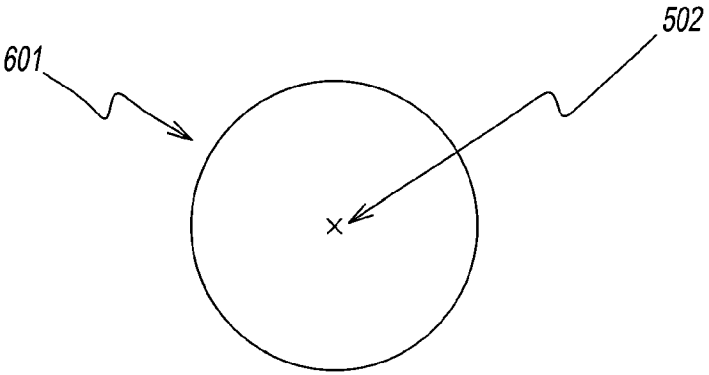
FIG. 16 is a top view of the flat liner of FIG. 14.

Referring to FIGS. 14-16, a flat liner 601 comprises a score mark 502 designed to rupture in a controlled fashion.

Recessed liner 501 and flat liner 601 each comprises a suitable material to allow it to flex and stretch and return to its original shape. For example, the suitable material is an elastic material that returns to its original state or shape after being stretched.

Figure 18:
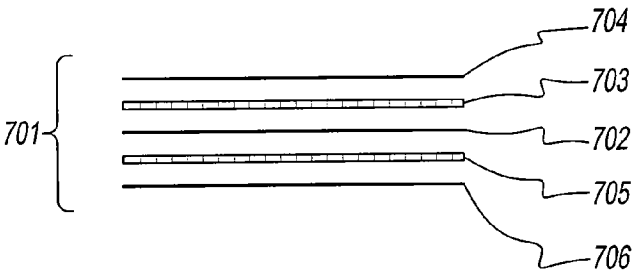
FIG. 18 is an exploded view of the layers of the multi-layer active insert device of FIG. 17.
Figure 17:
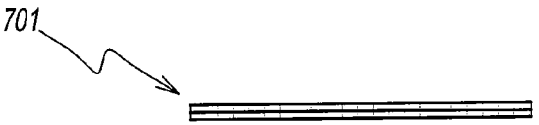
FIG. 17 is side view of a multi-layer active insert device.

Referring to FIGS. 17 and 18, a multi-layer active insert device 701 comprises a lamination of a plurality of layers. Multi-layer active insert device 701 preferably has a disc shape, although other suitable shapes may be used. Multi-layer active insert device 701 comprises an inductor layer 702, which is electrically conductive. A reactant layer 703 has a bottom surface bonded to a top surface of inductor layer 702 and a top surface that is bonded to an insulator layer 704. A reactant layer 705 has a top surface bonded to a bottom surface of inductor layer 702 and a bottom surface that is bonded to an insulator layer 706.

Figure 20:
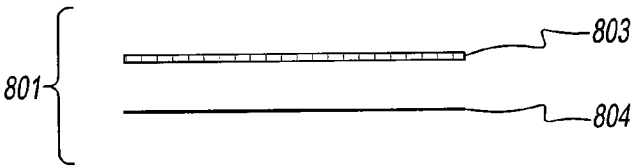
FIG. 20 is an exploded view of the layers of the bi-layer active insert device of FIG. 19.
Figure 19:
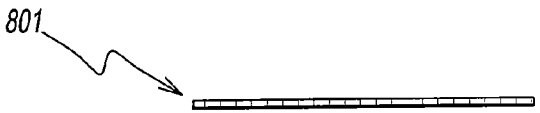
FIG. 19 is a side view of a bi-layer active insert device.

Referring to FIGS. 19 and 20, a bi-layer active insert device 801 comprises two layers that are laminated to one another. Bi-layer active insert device 801 preferably has a disc shape, although other suitable shapes can be used. Bi-layer active insert device 801 comprises an insulator layer 804 to which a reactant layer 803 is bonded.

Referring to FIGS. 21-24, a first embodiment comprises a container 920 that has a closed compartment 922, a neck finish 901 and an active closure device 902 disposed on neck finish 901. A product 923 partially fills container 920. A headspace 908 is between the surface of product 923 and the top of neck finish 901. Product 923, for example, may be a liquid.

Active closure device 902 comprises standard bottle closure 101 of FIGS. 1 and 2 into which multi-layer active insert device 701 of FIGS. 17 and 18 and recessed liner 501 of FIGS. 11 and 12 are inserted. First, multi-layer active insert device 701 is secured to the interior top surface of cap 101 by any suitable bonding or adhesive agent. Recessed liner 501 is then bonded to cap 101 using a suitable bonding agent to create a bond 903 such that multi-layer active insert device 701 is located in recess 503. Recess 503 and the interior top surface of cap 101 form an expansion chamber 905 shown in FIGS. 22-24.

Figure 22:
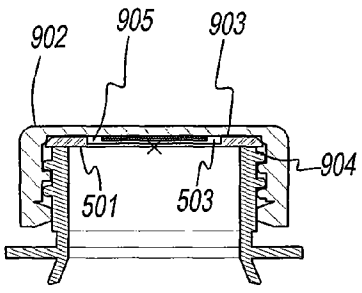
Figure 21:
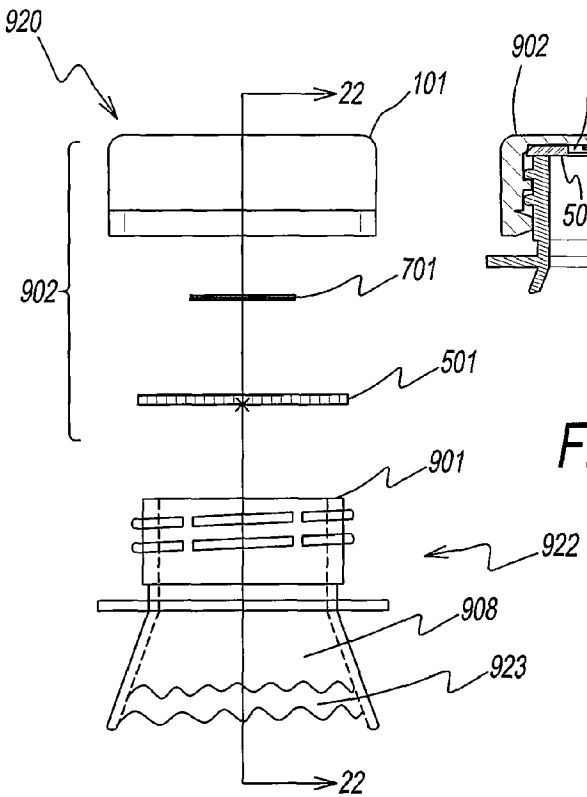
FIG. 21 is an exploded side view of a standard cap and container with the active insert device of FIG. 17 and the recessed liner of FIG. 11.

Referring to FIGS. 18 and 22, in the first step of the application process depicted in FIG. 22, active closure device 902 is screwed onto neck finish 901 with a suitable torque to create a hermetic seal 904 between recessed liner 501 and neck finish 901, which assures that expansion chamber 905 is an hermetically sealed chamber. In the second step of the application process depicted in FIG. 23, inductor 702 is heated by means of a current flow induced into it through the application of external electromagnetic energy 906. This heating is controlled by the intensity of electromagnetic energy 906 and the duration for which it is applied causing metallic inductor 702 to achieve precisely controlled temperatures. The heated inductor 702 causes the laminar bond of reactants 703 and 705 to break and causes reactant 703 and 705 to react through combustion or decomposition and produce a reaction product 907. The reaction product 907 comprises a mixture of gases and trace amounts of solids.

The reaction takes place in expansion chamber 905 and the evolution of reaction product 907 causes expansion chamber 905 to become pressurized.

The pressurization of expansion chamber 905 causes the recessed section of recessed liner 501 to stretch outward elastically, thereby causing score mark 502 to rupture. The rupturing of score mark 502 under pressure allows reaction product 907 to vent outward into headspace 908 thereby allowing headspace 908 to become filled and pressurized with reaction product 907.

Figure 24:
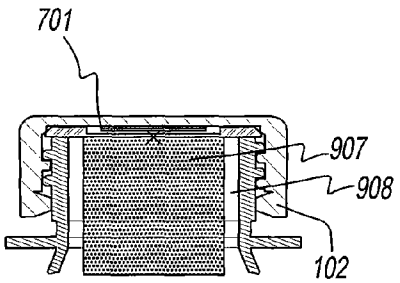
FIGS. 22-24 are cross-sectional views along line 22 of FIG. 21 representing various steps in the application process.
Figure 23:
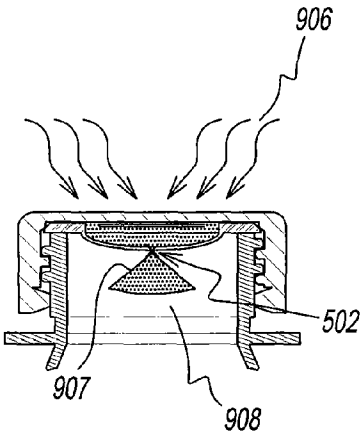

In the next step of the application process depicted in FIG. 24, reactants 703 and 705 become spent, eventually allowing the pressure in expansion chamber 905 to equalize with that in the headspace 908. At this point, since it has retained its elasticity, the recessed section of recessed liner 501 returns back to its original position, thereby causing the rupture along score mark 502 to close. Reaction product 907 becomes homogeneously mixed in headspace 908 thereby causing a constant pressure to be maintained. Multi-layer active insert device 701 is now spent and comprises only inductor 702 and insulator layers 704 and 706.

At the point of consumption, the active closure device 902 consisting of cap 101, recessed liner 501 and the spent multi-layer active insert device 701, which now includes inductor 702 and insulator layers 704 and 706, is unscrewed from neck finish 901 and removed. During the unscrewing process, the entire active closure device 902 is removed from neck finish 901 as one combined piece, with the exception of pilfer band 102, which becomes separated from cap 101 and remains on neck finish 901 to indicate that hermetic seal 904 has been broken.

In an alternate embodiment, the reaction takes place in active insert device 701. Insulator layers 704 and 706 are made of semi-permeable material. The reaction gas penetrates the semi-permeable insulator layers to enter expansion chamber 905 and expand the recessed section of recessed liner to expand and rupture as described above.

Referring to FIGS. 25-28, a second embodiment comprises a container 930 that has a closed compartment 922, a neck finish 901 and an active closure device 1001 disposed on neck finish 901. Some of the elements of container 930 are identical to corresponding elements of container 920 and bear like reference numerals.

Active closure device 1001 comprises recessed bottle closure 110 of FIGS. 3 and 4 into which multi-layer active insert device 701 of FIGS. 17 and 18 and flat liner 601 of FIGS. 14 and 15 are inserted. First multi-layer active insert device 701 is secured to a bottom of recess 201. Flat liner 601 is bonded to the inside of cap 111 using a suitable bonding agent to create a bond 903. Recess 201 and flat liner 601 form an expansion chamber 915 around multi-layer active insert device 701.

Figure 26:
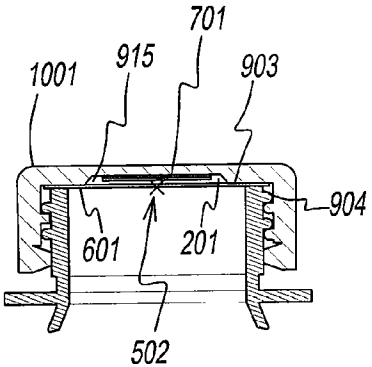
Figure 25:
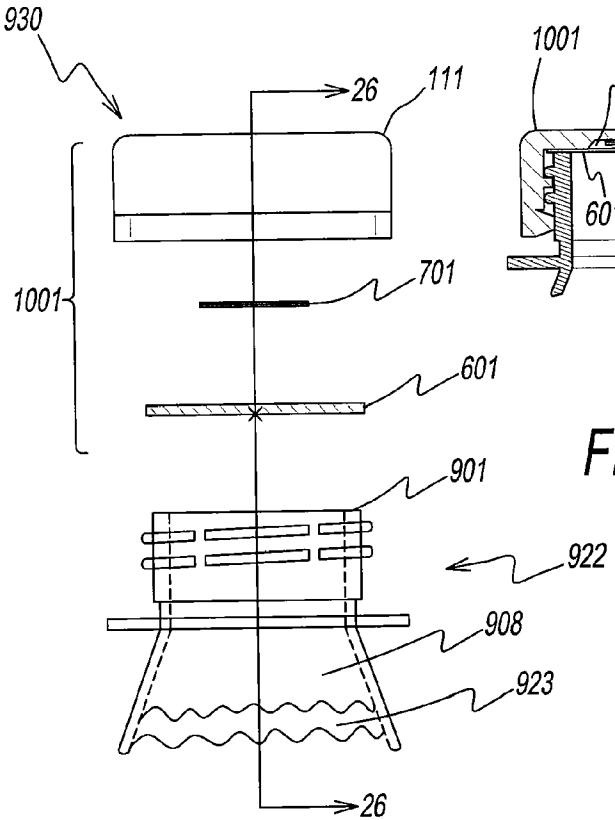
FIG. 25 is an exploded side view of a recessed cap and container with the active insert device of FIG. 17 and the flat liner of FIG. 14.

Referring to FIGS. 18 and 26, in the first step of the application process depicted in FIG. 26, active closure device 1001 is screwed onto neck finish 901 with a suitable torque to create a hermetic seal 904 between flat liner 601 and neck finish 901, which assures that expansion chamber 915 is an hermetically sealed chamber. In the second step of the application process depicted in FIG. 27, inductor 702 is heated by means of a current flow induced into it through the application of external electromagnetic energy 906. This heating is controlled by the intensity of the electromagnetic energy 906 and the duration for which it is applied causing metallic inductor 702 to achieve precisely controlled temperatures. Heated inductor 702 causes the laminar bond of reactants 703 and 705 to break and causes reactants 703 and 705 to react through combustion or decomposition and produce a reaction product 907. Reaction product 907 comprises a mixture of gases and trace amounts of solids. The reaction takes place in expansion chamber 915 and the evolution of reaction product 907 causes expansion chamber 915 to become pressurized. The pressurization of expansion chamber 915 causes flat liner 601 to stretch outward elastically, thereby causing score mark 502 to rupture. The rupturing of score mark 502 under pressure allows reaction product 907 to vent outward into headspace 908 thereby allowing headspace 908 to become filled and pressurized with reaction product 907.

Figure 28:
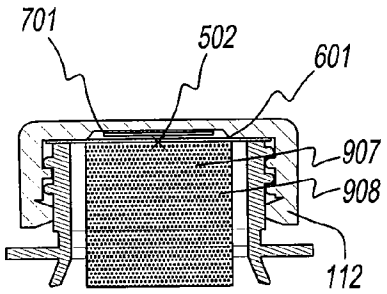
FIGS. 26-28 are cross-sectional views along line 26 of FIG. 25 representing various steps in the application process.
Figure 27:
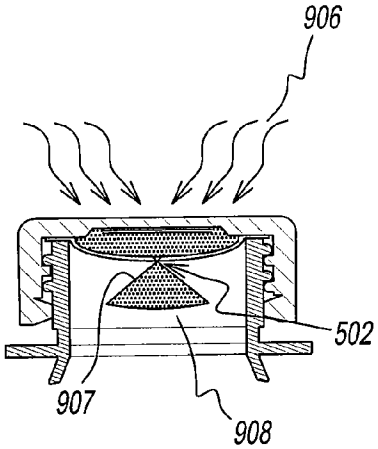

In the next step of the application process depicted in FIG. 28, reactants 703 and 705 become spent, eventually allowing the pressure in expansion chamber 915 to equalize with that in headspace 908. At this point, since it has retained its elasticity, flat liner 601 returns back to its original position, thereby causing the rupture along score mark 502 to close. Reaction product 907 becomes homogeneously mixed in headspace 908 thereby causing a constant pressure to be maintained. Multi-layer active insert device 701 is now spent and comprises only inductor 702 and insulator layers 704 and 706.

At the point of consumption, active closure device 1001 including cap 111, flat liner 601 and the spent multi-layer active insert device 701, which now includes metallic inductor 702 and two layers of insulator 704, is unscrewed from neck finish 901 and removed. During the unscrewing process, the entire active closure device 1001 is removed from the neck finish as one combined piece, with the exception of the pilfer band 112, which becomes separated from cap 111 and remains on neck finish 901 to indicate that hermetic seal 904 has been broken.

In an alternate embodiment, the reaction takes place in active insert device 701. Insulator layers 704 and 706 are made of semi-permeable material. The reaction gas penetrates the semi-permeable insulator layers to enter expansion chamber 915 and expand the recessed section of recessed liner to expand and rupture as described above.

Referring to FIGS. 29-32, a third embodiment comprises a container 940 that has a closed compartment 922, a neck finish 901 and an active closure device 1101 disposed on neck finish 901. Some of the elements of container 940 are identical to corresponding elements of containers 920 and 930 and bear like reference numerals.

Active closure device 1101 comprises the recessed bottle closure 130 of FIGS. 8-10 with transparent window 301 into which bi-layer active insert device 801 (FIGS. 19 and 20) and flat liner 601 (FIGS. 14-16) are inserted. Bi-layer active insert device 801 is secured to a bottom of recess 201. Flat liner 601 is bonded to the inside of cap 131 using a suitable bonding agent to create a bond 903. Recess 201 of recessed bottle closure 131 and flat liner 601 form an expansion chamber 925 around bi-layer active insert device 801.

Figure 30:
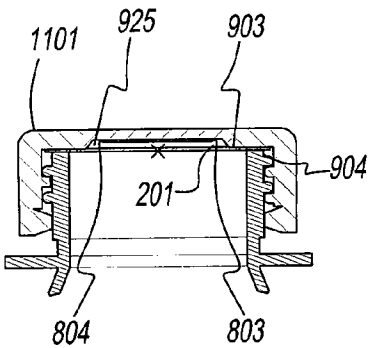
Figure 29:
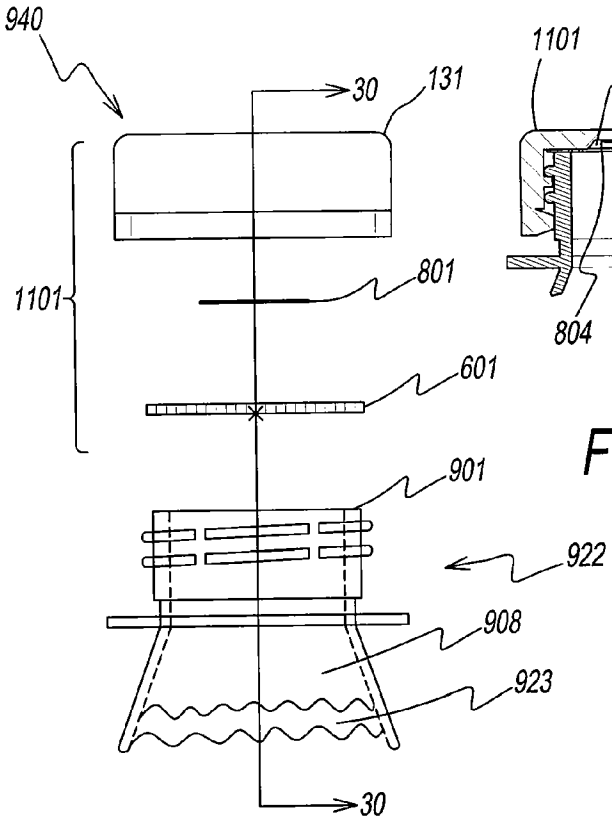
FIG. 29 is an exploded side view of a recessed cap and container with the active insert device of FIG. 19 and the flat liner of FIG. 14.

Referring to FIGS. 20 and 29-32, in the first step of the application process depicted in FIG. 30, active closure device 1101 is screwed onto neck finish 901 with a suitable torque to create a hermetic seal 904 between flat liner 601 and neck finish 901, which assures that expansion chamber 925 is an hermetically sealed chamber. In the second step of the application process depicted in FIG. 31, light energy 1102 is passed through the transparent window 301 and allowed to come into contact with reactant 803 that is bonded to insulator 804 that together make up bi-layer active insert device 801 as shown in FIG. 20. Light energy 1102 initiates a reaction through photo initiation of reactant 803. This reaction is a combustion or decomposition reaction that produces reaction product 907. Reaction product 907 comprises a mixture of gases and trace amounts of solids. The reaction takes place in the expansion chamber 925 and the evolution of reaction product 907 causes expansion chamber 925 to become pressurized. The pressurization of the expansion chamber 925 causes flat liner 601 to stretch outward elastically, thereby causing score mark 502 to rupture. The rupturing of score mark 502 under pressure allows reaction product 907 to vent outward into headspace 908 thereby allowing headspace 908 to become filled and pressurized with reaction product 907.

Figure 32:
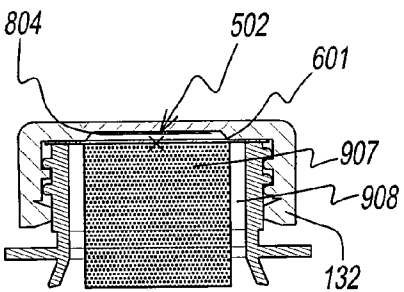
FIGS. 30-32 are cross-sectional views along line 30 of FIG. 29 representing various steps in the application process.
Figure 31:
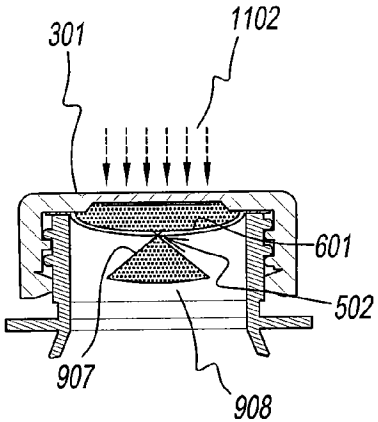

In the next step of the application process depicted in FIG. 32, reactant 803 becomes spent, eventually allowing the pressure in expansion chamber 935 to equalize with that in the headspace 908. At this point, since it has retained its elasticity, flat liner 601 returns back to its original position, thereby causing the rupture along score mark 502 to close. Reaction product 907 becomes homogeneously mixed in the headspace 908 thereby causing a constant pressure to be maintained. Bi-layer active insert device 801 is now spent and now comprises only insulator 804. At the point of consumption, active closure device 1101 comprising cap 131, flat liner 601 and the spent bi-layer active insert device 801 now comprising insulator 804, is unscrewed from neck finish 901 and removed. During the unscrewing process, the entire active closure device 1101 is removed from neck finish 901 as one combined piece, with the exception of the pilfer band 132, which becomes separated from the cap 131 and remains on neck finish 901 to indicate that hermetic seal 904 has been broken.

Without reference to any specific figure, the following should be noted. The purpose of insulators 704, 706 and 708 is to provide protection to the inside of caps 101, 111, 121 or 131 and recessed liner 501 or flat liner 601 from any excessive heat or friction that may be caused by the combustion or decomposition reaction of the reactant layers 703, 705 or 803. The heat and or friction caused by the combustion or decomposition reaction of reactant 703, 705 or 803 inside expansion chamber 905, 915 or 925 also acts to sterilize the inside of expansion chamber 905, 915 or 925 and its contents prior to score mark 502 rupturing and allowing reaction product 907 to vent into headspace 908.

The void of expansion chamber 905, 915 or 925 may be filled with air, inert gas, liquid, gel, solids or a mixture containing those. Score mark 502 may alternatively be multiple score marks and may be located and arranged in any other place and/or pattern on the recessed liner 501 or flat liner 601. The shape of laminated multi-layer active insert device 701 and bi-layer active insert device 801 may not be limited to circular and may take on any shape that allows it to fit inside recess 503 of recessed liner 501 or the active insert recess 201 of caps 111 or 131.

Reaction product 907 consists of gases and trace amounts of solids which can be any of or a combination of nitrogen, nitrous oxide, carbon monoxide, carbon dioxide, vitamins, minerals, colorants, odorants, preservatives or any other food additive or ingredient with a purpose of preserving or altering the state of headspace 908 or the contents of sealed containers 920, 930 or 940.

The lamination process of bonding reactants 703, 705 and 803, metallic inductor 702 and insulators 704, 706 and 804 to form multi-layer active insert device 701 and bi-layer active insert device 801 can be any of or a combination of spray coating, slurry coating, electrostatic deposition, painting, silk screening or any other conversion process that allows the lamination to be realized. Each of reactant layers 703, 705 and 803 is a formulation comprising a blend of any or all of certain gas generating propellants, oxidizers, stabilizers, binders and ingredients from the groups of organic and inorganic compounds, for example, high nitrogen compounds, azo and nitro compounds, amines, tetrazoles, ammonium compounds and the metal salts thereof.

Recessed liner 501 and flat liner 601 can be any material that provides the elasticity to deform and return to the original shape, provides ability to be bonded with bond 903 to caps 101, 111, 121 or 131 and provides the ability to form a suitable hermetic seal 904 onto neck finish 901. Recessed liner 501 and flat liner 601 can be shaped with an opening exposing reactant 703, 705 and 803 and inductor 702 to the contents of containers 920, 930 or 940 allowing the reaction and reaction product 907 to occur directly in head space 908 which acts as the expansion chamber enabling head space sterilization, combustion and degradation of gases, and scavenging all oxygen in the head space 908. Liner 601 acts as a sealing liner to create hermetic seal 904 between itself and neck finish 901 so that the reaction product is contained within the container. The opening is a large score mark, or just a permanent opening that does not close itself after the completion of the reaction.

Inductor 702 can any electrically conductive material, metallic or non metallic, that allows a current to be induced in it through the application of an electromagnetic field or other external energy source. Inductor 702 can be any shape for example a disc, doughnut or other multi dimensional geometric shape. Insulator 704 can be made up of any material that provides a thermal insulating effect or protection from friction or abrasion caused by the reaction of reactants 703, 705 and 803 and can be any shape, for example, a disc, doughnut or other multidimensional geometric shape.

Furthermore, it will be apparent to those skilled in the art that the initiation of the reaction that combusts or decomposes reactants 703, 705 and 803 into reaction product 907 can be initiated by means other than thermal induction and photo initiation as described in the embodiments above, as well as by other means. For example, the reaction could be alternately be initiated (1) thermally through external heating, friction generated through either mechanical or ultrasonic energy, infrared light spectrum or electric heating coil or other external energy source that induces this effect; (2) through shock, impact or vibration through the application of mechanical force, ultrasonic energy, microwave radiation or other external energy source that induces this effect; (3) electrically through an electrostatic discharge or other external energy source that produces this effect; and (4) through directed radiation of energetic particles and electromagnetic energy or other external energy source that produces this effect.

The present invention having been thus described with particular reference to the preferred forms thereof, it will be obvious that various changes and modifications may be made therein without departing from the spirit and scope of the present invention as defined in the appended claims.

What is claimed is:

1. A container assembly comprising:

a bottle comprising:

an interior;

a neck finish;

an upper rim defining an opening at a distal end of said neck finish; and a closure comprising:

a closed top;

a skirt fastened to said neck finish for closing said opening of said bottle;

an active insert secured to an interior surface of said closed top, and housing at least one reactant;

a liner bonded to said interior surface of said closed top to form a hermetic seal between said interior surface of said closed top and said rim of said bottle and to form an expansion chamber surrounding said active insert, said expansion chamber comprising:

an elastic portion that expands from an unstretched condition to a stretched condition as pressure within said expansion chamber increases and then contracts from said stretched condition to said unstretched condition when pressure within said expansion chamber equilibrates with pressure of said interior of said bottle;

a valve within said elastic portion that opens to release gas into said interior of said bottle as said pressure within said expansion chamber increases and then closes as said elastic portion contracts to said unstretched condition;

wherein said at least one reactant is triggerable to a reaction by an external energy source to produce gas in said expansion chamber to increase pressure of said expansion chamber and to expand said elastic portion of said expansion chamber to open said valve through which said gas is released to said interior of said bottle.

2. The container assembly of claim 1, wherein said active insert is spaced from said liner.

3. The container assembly of claim 1, wherein said reaction is a type selected from the group consisting of: chemical decomposition, combustion, substitution, acid-base, Redox or organic reaction.

4. The container assembly of claim 1, wherein said external energy source produces the triggering of said reaction with energy selected from the group consisting of: thermal induction; photo initiation; thermally through external heating, friction generated through either mechanical or ultrasonic energy, infrared light spectrum or electric heating coil; shock, impact or vibration through the application of mechanical force, ultrasonic energy, microwave radiation; electrically through an electrostatic discharge; and directed radiation of energetic particles and electromagnetic energy.

5. The container assembly of claim 1, wherein said liner further comprises a planar surface or a recess.

6. The container assembly of claim 1, wherein said liner comprises a recess housing said active insert.

7. The container assembly of claim 1, wherein said external energy source provides electromagnetic energy, wherein said active insert comprises an inductor that responds to said electromagnetic energy to trigger said reaction.

8. The container assembly of claim 1, wherein said active insert device is disposed in a recess of said closure.

9. The container assembly of claim 1, wherein said active insert further comprises a first layer bonded to a second layer, and wherein said at least one reactant is disposed between said first and second layers.

10. The container assembly of claim 1, wherein said active insert further comprises a layer bonded to said reactant.

11. The container assembly of claim 1, wherein said neck finish is threaded and said skirt is threaded.

12. The container assembly of claim 1, wherein said reactant is a blend of any one or more selected from the group consisting of: gas generating propellants, oxidizers, stabilizers, binders, organic compounds and inorganic compounds.

13. The container assembly of claim 12, wherein said organic and inorganic compounds are selected from the group consisting of: azo and nitro compounds, amines, tetrazoles, ammonium and metal salts.

14. The container assembly of claim 1, wherein said external energy source provides light energy, wherein said active insert responds to said light energy to trigger said reaction.

15. The container assembly of claim 14, said closure further comprising a transparent section, and wherein said light energy is incident to said transparent section.

* * * * *